US005317782A

United States Patent [19]

Matsuura et al.

[11] Patent Number: 5,317,782

[45] Date of Patent: Jun. 7, 1994

[54] SYSTEM FOR CLEANING AN INSIDE SURFACE OF A DUCT

[75] Inventors: Kenji Matsuura, Moriyama; Katsumi Toritani, Miki, both of Japan

[73] Assignees: Ataka Construction & Engineering Co., Ltd., Osaka; Kobe Mechatronics Co., Ltd., Kobe, both of Japan

[21] Appl. No.: 98,159

[22] Filed: Jul. 28, 1993

Related U.S. Application Data

[63] Continuation of Ser. No. 887,030, May 22, 1992, abandoned.

[30] Foreign Application Priority Data

Mar. 13, 1992 [JP] Japan ..... 4-089878

[51] Int. Cl.[5] ..... A47L 9/02

[52] U.S. Cl. ..... 15/324; 15/339; 15/340.1; 15/406

[58] Field of Search ..... 15/104.05, 104.09, 324, 15/339, 340.1, 381, 406; 134/167 C, 168 C, 113

[56] References Cited

U.S. PATENT DOCUMENTS

| | | | |
|---|---|---|---|
| 2,358,557 | 9/1944 | Boyd et al. | 15/406 X |
| 3,074,098 | 1/1963 | Downing | 15/406 X |
| 3,655,122 | 4/1972 | Brown et al. | 134/167 C X |
| 4,690,159 | 9/1987 | Vadakin et al. | 134/167 C |
| 4,985,763 | 1/1991 | Fraser | 134/167 C X |
| 4,986,314 | 1/1991 | Himmler | 15/104.09 X |
| 5,018,545 | 5/1991 | Wells | 134/167 C X |
| 5,020,188 | 6/1991 | Walton | 15/406 |

*Primary Examiner*—Stephen F. Gerrity
*Attorney, Agent, or Firm*—Edwin E. Greigg; Ronald E. Greigg

[57] ABSTRACT

A system including an apparatus for cleaning an inside surface of a duct. The system includes a traveling portion and a remote-control monitor portion. The traveling portion includes a traveling truck and the truck carries a compressed air ejector and a video camera, and the remote-control monitor portion receives images from the video camera to control remotely the traveling portion while monitoring a front view of the traveling portion in accordance with the signal coming from the video camera. The compressed air ejector is equipped with a rotating nozzle for ejecting compressed air toward the duct inside surface in an oblique direction in front of the traveling truck. An air compressor can be carried by the truck or the compressed air can be fed to the nozzle ejector via a hose from outside the duct.

8 Claims, 3 Drawing Sheets

SYSTEM FOR CLEANING AN INSIDE SURFACE OF A DUCT

This is a continuation of copending application Ser. No. 07/887,030 filed on May 22, 1992 now abandoned.

FIELD OF THE INVENTION AND PRIOR ART STATEMENT

1. Field of the Invention

This invention relates to a system including an apparatus for cleaning inside the surface of a duct.

2. Description of the Prior Art

Heretofore, an apparatus for cleaning an inside surface of a duct made use of large robot which could be used only in a large duct. And in case of an ordinary middle or small sized duct, either an air flow through the duct has been performed, or, in most cases where such an air flow has been ineffective, cleaning has been done by hand.

In case of cleaning the inside surface of an ordinary, middle or small sized duct by hand, the cleaning has never gone well because of a difficulty of the work itself or for preparing the workers. Without proper cleaning, mold and bacteria have grown or dust has accumulated in the duct, and accumulation of such foreign substances has been considered to be a cause of infections in a hospital or food poisoning in a restaurant. Henceforth, with an expectable increase of small sized ducts, the above problems will accumulate still more.

OBJECT AND SUMMARY OF THE INVENTION

It is an object of this invention to provide a system including a cleaning apparatus which avoids the above noted problems and is effectively usable in place of a man particularly in a middle or small sized duct.

To attain the above object, the duct cleaning apparatus of the present invention comprises a traveling portion and a remote-control monitor portion, said traveling portion having a traveling truck which carries a compressed air ejector and video camera, and said remote-control monitor portion being able to remotely control said traveling portion while monitoring the area in front of said traveling portion in accordance with the signal coming from said video camera. The apparatus includes a compressed air ejector equipped with a rotating nozzle for ejecting compressed air toward the inside duct surface in oblique front of said traveling truck.

In addition to said first characteristic, the duct cleaning apparatus of the present invention includes a rotating nozzle which rotates to cover an angle of 360 degrees.

In addition to said first characteristic, the nozzle of the duct cleaning apparatus of the present invention may be the nozzle operates reciprocatively within the range of an angle of 180 degrees which covers the lower half part of the inside surface of the duct.

In addition to said first characteristic, the nozzle of the duct cleaning apparatus may be made to stop at either a leftward or a rightward horizontal position inside the duct.

In addition to the rotating nozzle of the cleaning apparatus, a straightly-ejective nozzle which ejects compressed air concentratedly toward a narrow area of the duct inside surface in front of the traveling truck may be used.

In addition to said first or fifth characteristic, the traveling truck of the duct cleaning apparatus may be equipped with guide rollers for guiding the progressive direction of said traveling truck by keeping contact with the inside wall surface of the duct.

The six characteristics of the present invention yield operational effects as follows.

By virtue of said first characteristic, the remote-control monitor portion monitors an image coming from the video camera, an operator sends a signal to the portion travel inside the duct which operates the rotating nozzle to eject compressed air; as a result, the compressed air is blown against the inside surface of the duct obliquely in front of the advancing traveling truck, successively in the duct circumferential direction; as a result, any foreign substances, like trash and dust, accumulated on or attached to the inside surface of the duct are successively cleaned out; and the foreign substances are blown away and discharged out of the duct opening in front of the traveling truck.

By virtue of said second characteristic, in addition to the operational effect brought about by said first characteristic; the rotating nozzle is rotated covering an angle of 360 degrees; resultingly, the compressed air is successively blown against the circumference of the inside surface of the duct; and as a result, trash and dust are evenly cleaned out throughout the whole circumference of the duct inside surface.

By virtue of said third characteristic, in addition to the operational effect brought about by said first characteristic; the rotating nozzle is rotated reciprocatively within the range of an angle of 180 degrees covering the lower half part inside the duct; and resultingly, the lower half part inside the duct where trash and dust are liable to accumulate can be efficiently and swiftly cleaned out.

By virtue of said fourth characteristic, in addition to the operational effect brought about by said first characteristic; the rotating nozzle is stopped at either a leftward or a rightward horizontal position inside the duct; and resultingly, the left and right wall parts inside the duct ca be preponderantly cleaned out.

By virtue of said fifth characteristic, in addition to the operational effect brought about by said first characteristic; when foreign substances are found to be firmly attached to a specific narrow area of the duct inside surface, the compressed air is ejected from the straightly-ejective nozzle toward said narrow area of the duct inside surface in front of the traveling truck; and as a result, the foreign substances and the like accumulated on said narrow area of the duct inside surface are preponderantly and powerfully cleaned out by said compressed air.

By virtue of said sixth characteristic, in addition to the operational effect brought about by said first or fifth characteristic; when the traveling truck, while traveling, approaches the left or right wall surface inside the duct, the guide rollers guide the progressive direction of the truck by keeping contact with the above wall surface; and resultingly, the traveling truck can travel without being brought into direct contact with the above wall surface, and is never stagnated even at the curvatures inside the duct.

DESCRIPTION OF THE PREFERRED EMBODIMENT

Figure 1:
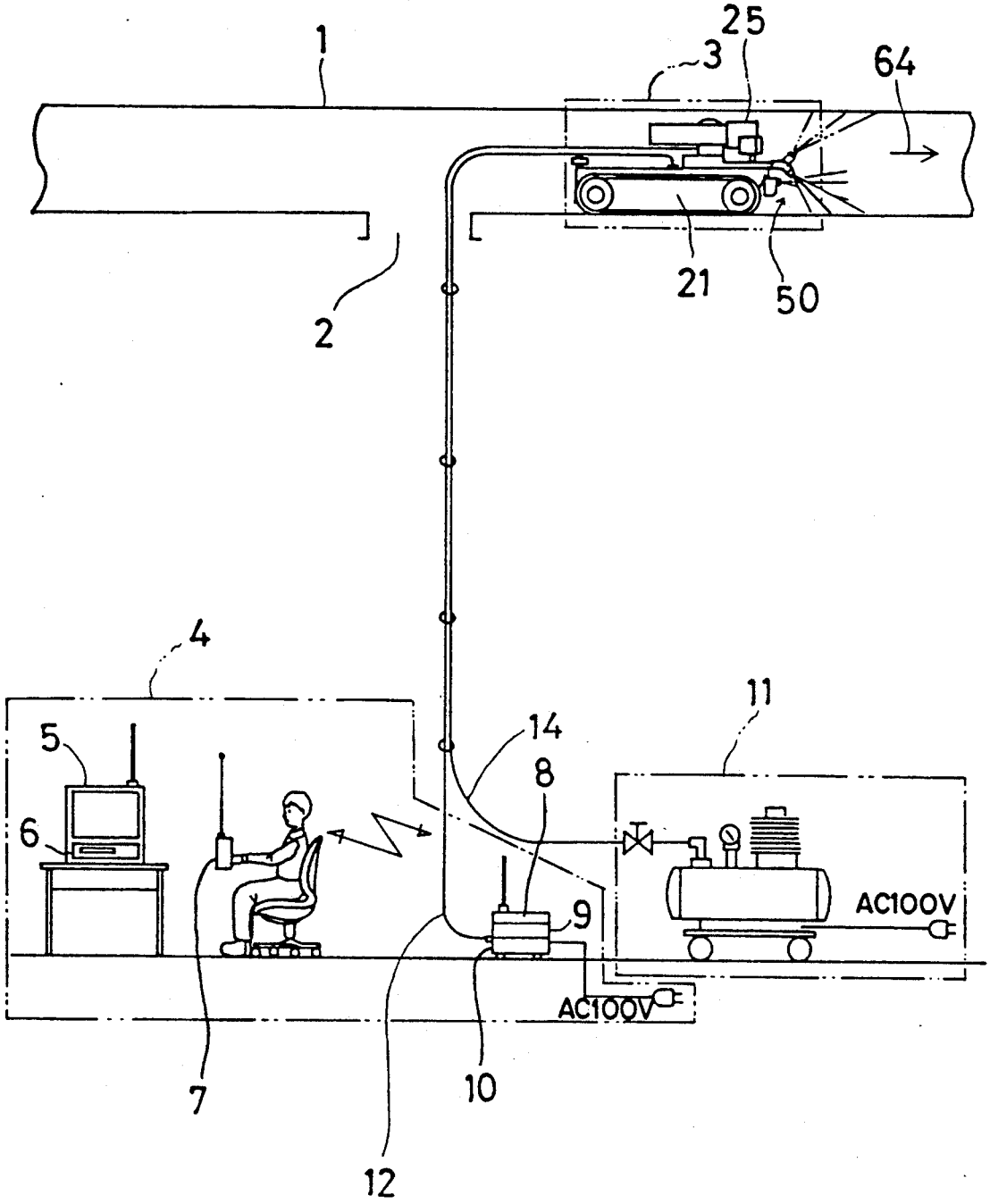
FIG. 1 is an illustrative drawing showing the whole aspect of the preferred embodiments of the present invention.
Figure 2:
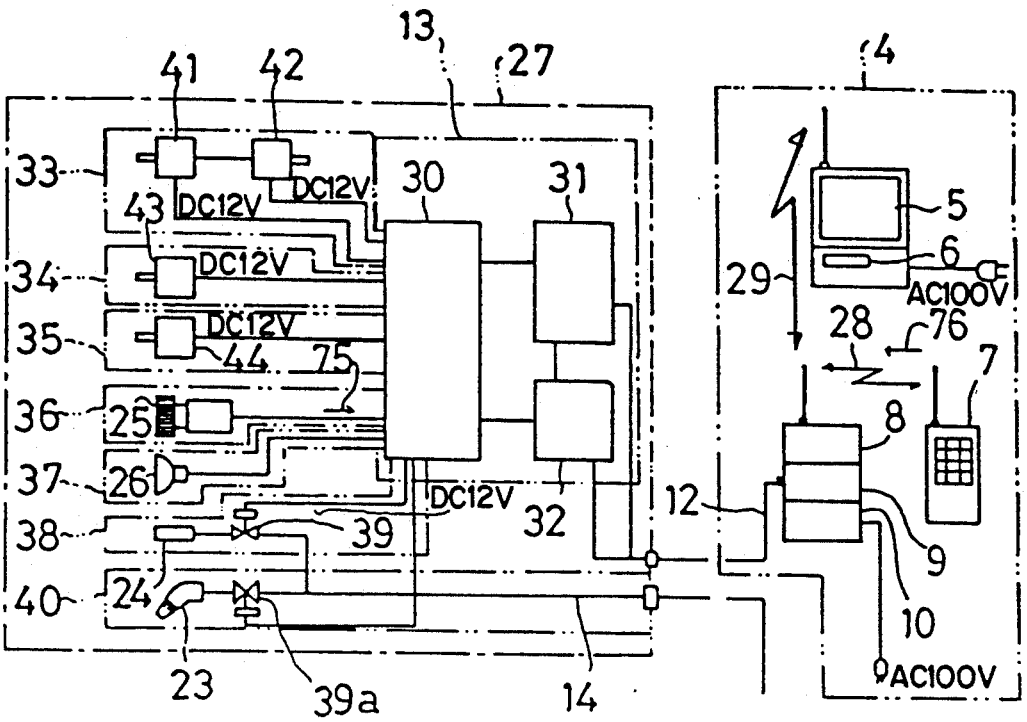
FIG. 2 is a schematic block diagram showing the outline of a controller for the traveling portion on board the traveling portion and the remote-control monitor portion remotely connected to said traveling portion controller in said preferred embodiments.
Figure 3:
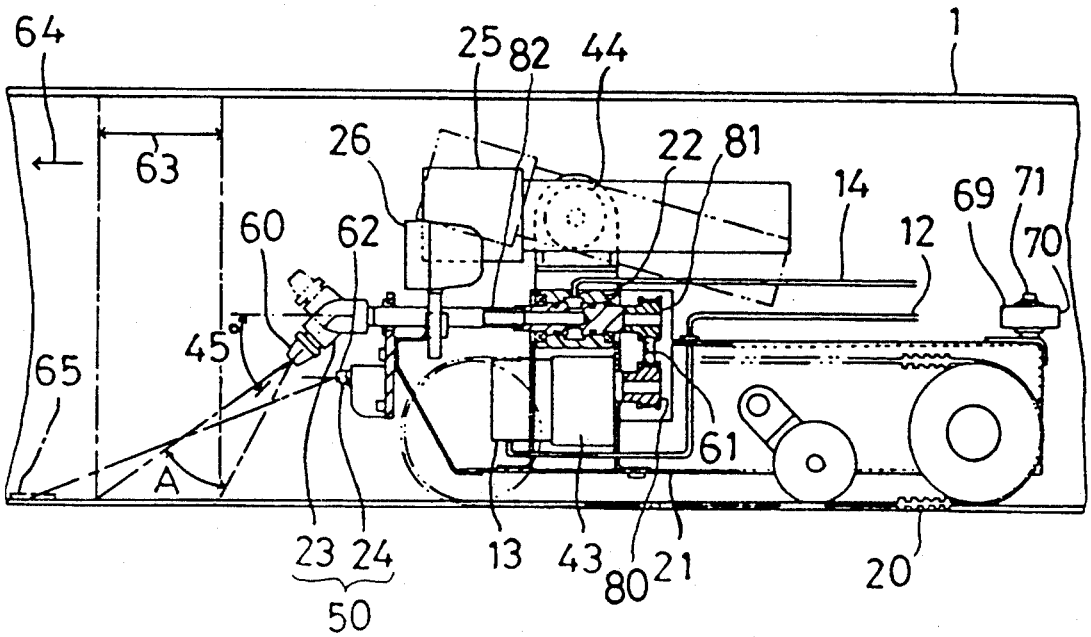
FIG. 3 is a detailed side view showing the traveling portion in said preferred embodiments.
Figure 4:
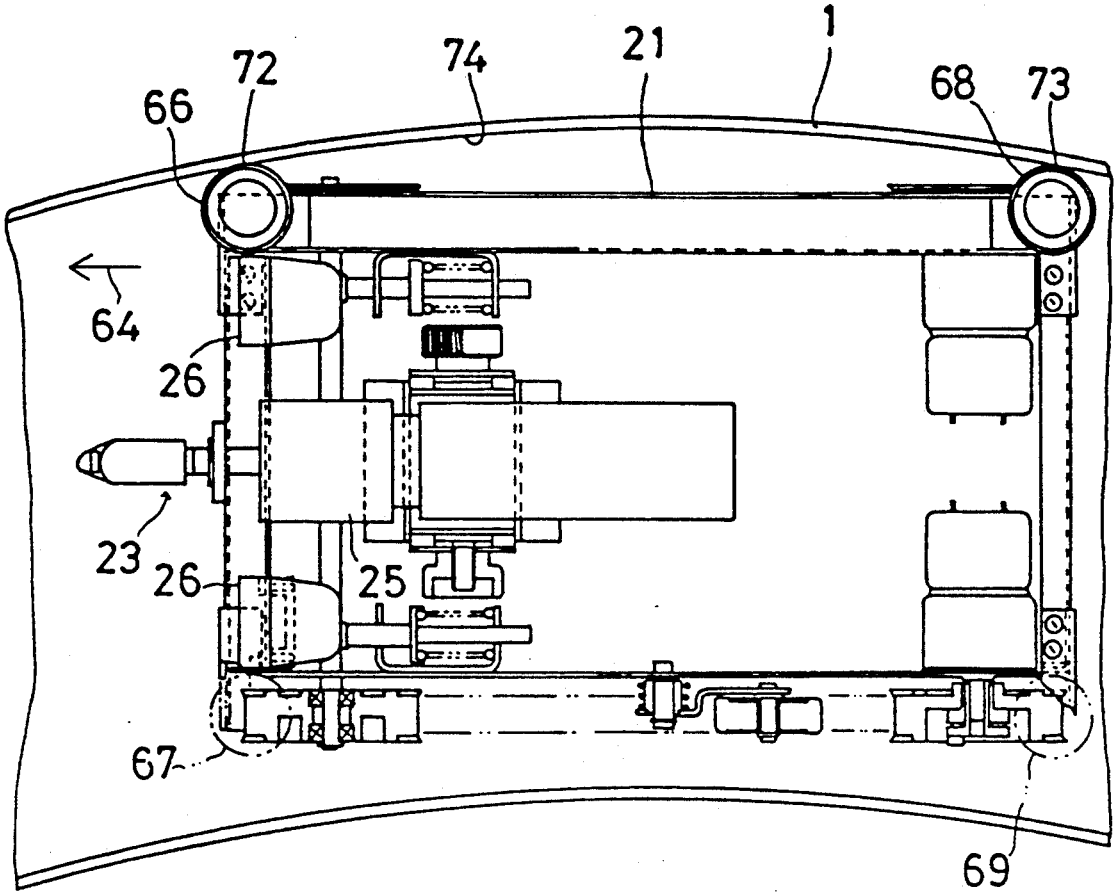
FIG. 4 is a detailed plan view showing the traveling portion in said preferred embodiments.
Figure 5:
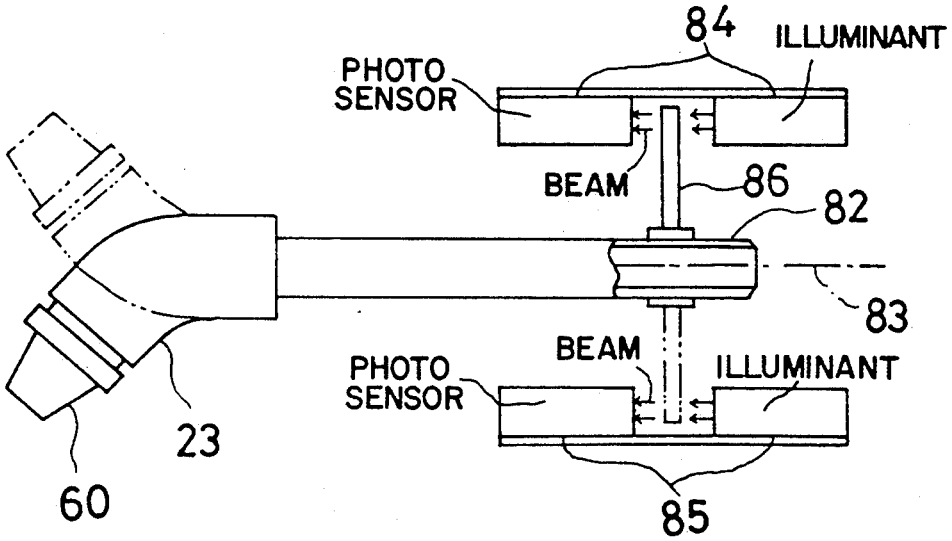
FIG. 5 is a plan view showing the main shaft to the rotating nozzle and optical position detecting elements for detecting the rotating position of said main shaft in said preferred embodiments.

The preferred embodiments of the duct cleaning apparatus of the present invention will be described in accordance with FIG. 1 to FIG. 5. FIG. 1 is an illustrative drawing showing the whole aspect of the preferred embodiments of the present invention, FIG. 2 is a schematic block diagram showing the outline of the traveling portion controller on board the traveling portion and the remote-control monitor portion remotely connected to said traveling portion controller in said preferred embodiments; FIG. 3 is a detailed side view showing the traveling portion in said preferred embodiments; FIG. 4 is a detailed plan view showing the traveling portion in said preferred embodiments, and FIG. 5 is a plan view showing the main shaft to the rotating nozzle and optical position detecting elements for detecting the rotating position of said main shaft in said preferred embodiments.

In FIG. 1, 1 is a duct; 2 is an entry of equipment and materials to the duct 1; 3 is a traveling portion carried in through the entry 2; 4 is a remote-control monitor portion whose first function is to execute monitoring the front of the traveling portion 3 by using a TV 5 and a VTR 6 in accordance with the signal given by a video camera 25 on board the traveling portion 3 and whose second function is, while executing the above monitoring, to execute remote-controlling of the traveling portion 3 by using a remote-control switch 7; 8 is a transceiver; 9 is a video amplifier; 10 is a power supply unit supplied with AC-100 V, having a battery built-in to enable itself to work about 5 hours even when said AC-100V supply is interrupted; 11 is a compressor for generating compressed air; 12 is an antenna line for transmitting the signal sent out from the remote-control monitor portion 4 to the traveling portion 3 and for transmitting the signal of the video camera 25 sent back from the traveling portion 3 to the remote-control monitor portion 4; 14 is an air pipe for transmitting the compressed air generated by the compressor 11 to the traveling portion 3; 21 is a traveling truck of the traveling portion 3, equipped with crawlers 20 as shown in FIG. 3; 50 is a compressed air ejector; and 64 is a direction in which the traveling portion 3 progresses inside the duct 1

Further explanation will be given referring to FIGS. 2, 3, 4, and 5. 22 is an air joint to receive the compressed air transmitted through said air pipe 14; 23 is a rotating nozzle in said compressed air ejector 50; 24 is a straightly-ejective nozzle in the same compressed air ejector 50 25 is a video camera; 26 is a double illuminating lamp for helping the video camera 25 take pictures; and 13 is the central part of a traveling portion controller 27.

Regarding the traveling portion controller 27 (as shown in FIG. 2) and the remote-control monitor portion 4 connected remotely to said traveling portion controller 27 in the preferred embodiments; 4, 5, 6, 7, 8, 9, 10, 12 and 14 have already been described. Among them, the transceiver 8 plays a pivotal role at the side of the remote-control monitor portion 4 in exchanging signals between the traveling portion controller 27 via said antenna line 12. Said transceiver 8 firstly, receives the signal 75 generated by the video camera 25 of the traveling portion controller 27, via a control substrate 30 and a signal converter 32 in the central part 13 of the same traveling portion controller 27; secondly, transceiver transmits the signal 75 to the TV 5 and the VTR 6 in the remote-control monitor portion 4, via a radio wave line 29 in the same remote-control monitor portion 4; thirdly, makes "the scene inside the duct 1 and in front of the traveling portion 3 caught by the video camera 25" changed immediately into the images of the TV 5 and the VTR 6; fourthly, receives later described operating signals 76 which an operator sends out by using the remote-control switch 7 in accordance with said images of the TV 5 and the VTR 6, via a radio wave line 28; fifthly, transmits said operating signals 76 to the control substrate 30, via the antenna line 12 and also via the signal converter 32 in the central part 13 of the controller 27 on the traveling portion, and thereby makes said control substrate 30 execute the control of each of the later-described several systems. 31 in the central part 13 of the controller 27 is a voltage regulator for regulating "the voltage to the electric machinery or electric machineries of each of the later-described several systems", i.e., "the voltage to each load of the control substrate 30"; the traveling portion includes system 33 comprising electric motor 41 and 42 of DC 12 V drive for propelling the traveling truck 21 of the traveling portion 3; 34 is a rotating nozzle rotating system comprising an electric motor 43 of DC 12 V drive for rotating the rotating nozzle 23; 35 is a camera tilt system comprising an electric motor 44 of DC 12V drive for giving the video camera 25 an appropriate tilt angle (refer to FIG. 3); 36 is a video camera system comprising the video camera 25; 37 is an illuminating lamp system comprising a double DC 6 V illuminating lamp 26; 38 is a straightly-ejective nozzle system, comprising the straightly-ejective nozzle 24, which ejects compressed air transmitted through the air pipe 14 via an electromagnetic valve 39 of DC 12 V drive; and 40 is a rotating nozzle system, comprising the rotating nozzle 23, which executes ejection by receiving the compressed air transmitted through the air pipe 14 via an electromagnetic valve 39*a*. Further, it should be added that, when the aforementioned remote-control switch 7 is used, several operating signals 76 to effect the following can be sent out: putting on or off the control substrate 30; making the traveling truck 21 relating to said system 33 turn left or right, or go ahead or backward, or stop; making the rotating nozzle 23 relating to said system 34 start or stop rotation; making the video camera 25 relating to said system 35 tilt upward or downward; turning on or off the illuminating lamp 26 relating to said system 37; and making the straightly-ejective nozzle 24 and the rotating nozzle 23 start ejection of the compressed air through the operation of the electromagnetic valves 39 and 39*a* of said systems 38 and 40.

The aforementioned rotating nozzle 23 is installed in the front part of the traveling portion 3, and is rotated by the electric motor 43 via a belted speed changer 61 (whose speed change ratio is determined by the ratio of the diameter of a belt pulley 80 to that of a belt pulley 81) while being supplied with the compressed air from the compressor 11 through the air pipe 14. And the rotating nozzle 23 is constructed such that it can make the compressed air ejected from a rotating nozzle tip part 60 bent by a fixed angle of, e.g., 45 degrees from the horizontal plane toward a cylindrical part 63 of the inside surface of the duct 1 with an appropriate ejection angle A, wherein said cylindrical part 63 is to be shifted successively in the progressive direction 64 of the traveling truck 3. The detailed plan view of said rotating nozzle 23 is as shown in FIG. 4.

The aforementioned rotating nozzle 23 can be rotated continuously covering an angle of 360 degrees, so it enables the compressed air to be blown successively and evenly against the whole circumference of the inside surface of the duct 1.

Besides, the rotating nozzle 23 may be made to rotate reciprocatively within the range of an angle of 180 degrees covering the lower half part inside the duct. For that purpose, the motor 43 itself may be made to rotate reciprocatively, or a part of the rotating nozzle system 40 may be equipped with a mechanism which can interchange 360 degrees' rotating motion with 180 degrees, reciprocative rotating motion. For instance, in order that the motor 43 itself may be made to rotate reciprocatively; as shown in FIG. 5, optical position detecting elements 84 and 85 horizontally and symmetrically positioned about the shaft center 83 of the main shaft 82 to the rotating nozzle 23 may be made to detect the rotating position of said main shaft 82 via "a single blade-like projection 86 fixed to and movable with the main shaft 82" and may be made to transmit the position detection signal to the motor 43 to make its rotating direction reversed in every 180 degrees of rotation. As a result of such as the above, the lower half part inside the duct where trash and dust are liable to accumulate, except the ceiling part where no dust and the like are liable to accumulate, can be efficiently and swiftly cleaned out.

Further, the rotation of the rotating nozzle 23 may be made to stop at either a leftward or a rightward horizontal position inside the duct. Such a stopping of the rotation of the rotating nozzle 23 may, for instance, be performed by transmitting the above position detection signal generated by the above optical position detecting elements 84 and 85 to the motor 43 and making the motor 43 stop. As a result of such as the above, the left and right wall surfaces inside the duct 1 can be preponderantly cleaned out.

The aforementioned straightly-ejective nozzle 24 is installed separately from the aforementioned rotating nozzle 23 and made to eject the compressed air concentratedly toward a specific area inside the duct 1, and constructed such that the direction of a straightly-ejective nozzle tip part 62 can be changed manually or automatically by the operation at the remote-control monitor portion 4 (the drawings in these embodiments illustrate the case of manual operation). Besides, the compressed air ejection angle of the tip part 62 is made to be so small that the compressed air is enabled to be blown concentratedly against a narrow area 65 inside the duct 1.

The aforementioned traveling truck 21 is equipped with guide rollers 66, 67, 68, and 69. Said guide rollers 66, 67, 68 and 69 are provided with roller outer rings as shown by 70 and made of rubber and supported on vertical axes as shown by 71 at the four corners of the traveling truck 21 so as to be rotatable freely, with said roller outer rings being made to project out of the outer frame of the traveling truck 21. Accordingly, as shown in FIG. 4, in case that the traveling truck 21 approaches a vertical wall surface 74 inside the duct 1, the right-hand wall surface facing the progressive direction 64 (of the traveling truck 21); the outer rings of said guide rollers 66 and 68 are brought into contact with said vertical wall surface 74 at the joints 72 and 73, roll and move on said wall surface 74, guide the progressive direction 64 of the traveling truck 21 running inside the duct 1, and thus enable the traveling truck 21 to advance inside the duct 1 smoothly. In case the duct 1 is curved as shown in FIG. 4, the function of the guide rollers as stated above becomes particularly effective.

The duct cleaning apparatus of the present invention comprises the aforementioned structure, brings about the aforementioned operational effects, and consequently yields overall effects as follows.

Firstly, said duct cleaning apparatus is equipped with the rotating nozzle which can be rotated under the operation of the remote-control monitor portion and can eject the compressed air toward the inside surface of the duct in an oblique direction in front of the traveling truck, so that said apparatus can successively clean the inside surface of the duct in an oblique front direction of the traveling truck as the truck advances and can remove foreign substances and the like attached to said inside surface of the duct.

Secondly, said duct cleaning apparatus, in addition to the above first effect, can, by making the rotating nozzle rotate covering an angle of 360 degrees, blow the compressed air against the circumference of the inside surface of the duct, and can thereby clean out trash and dust evenly throughout the whole circumference of the duct inside surface.

Thirdly, said duct cleaning apparatus, in addition to the above first effect, can, by making the rotating nozzle rotate reciprocatively within the range of an angle of 180 degrees covering the lower half part inside the duct, clean out efficiently and swiftly the lower half part inside the duct where trash and dust are liable to accumulate, except the ceiling part where no dust and the like are liable to accumulate.

Fourthly, said duct cleaning apparatus, in addition to the above first effect, can, by enabling the rotating nozzle to stop at either a leftward or a rightward horizontal position inside the duct, clean out preponderantly the left and right wall parts inside the duct.

Fifthly, said in-duct cleaning apparatus, in addition to the above first effect, can, by being equipped with the straightly-ejective nozzle which can eject the compressed air concentratedly toward a narrow area of the duct inside surface in front of the traveling truck under the operation of the remote-control monitor portion, clean preponderantly and powerfully a narrow area of the inside surface of the duct as needed, and thus can remove particular foreign substances and the like clinging to the narrow area.

Sixthly, said duct cleaning apparatus, in addition to the above first or firth effect, can, by being equipped with the guide rollers attached to the traveling truck for guiding the progressive direction of the traveling truck by keeping contact with the inside wall surface, of the duct, not only makes the traveling truck advance smoothly inside the duct without incurring any stagnation even at the duct curvatures but also make the truck driving motor entirely free from being excessively overloaded with direct contact between the truck side surface and the duct inside wall surface, and can thereby bring about the effect that the failure of said apparatus will be made to be minimized.

It can be summarized that the duct cleaning apparatus of the present invention can perform cleaning inside a duct too narrow for a man to enter; can perform, taking the place of a man and more skillfully than a man, a dirty, dangerous and severe work inside a duct even if the duct allows a man to enter; can serve to improve and to perform labor saving of said dirty, dangerous and severe jot site; and can, through duct cleaning, contribute to the improvement of environmental sanitation.

What is claimed is:

1. A system and apparatus for cleaning inside surfaces of a duct comprising:

a traveling means;

means for driving said traveling means forwardly and backwardly in an interior of the duct to be cleaned;

a monitor video camera supported on said traveling means for monitoring a state of cleanness of the interior of said duct;

an oscillatable compressed-air ejection nozzle carried on said traveling means and oscillatable through a predetermined angle around an oscillatable axis of said traveling means, said predetermined angle through which said compressed-air ejection nozzle is oscillated is 180 degrees;

said compressed-air ejection nozzle carried by said traveling means such that said oscillation axis is parallel with a central axis of said duct;

an air compressor for supplying compressed air to said compressed-air ejecting nozzle via a control valve in a compressed-air line between said air compressor and said traveling means, a monitor image display means for displaying an image taken by said monitor video camera; and a control means for controlling said driving means for controlling the travel of said traveling means and for controlling said control valve for ejection of compressed air in accordance with an image displayed on said monitored image display means.

2. A system and apparatus as defined in claim 1, wherein said traveling means is equipped with guide rollers for guiding said traveling means precisely along the interior of said duct.

3. A system and apparatus for cleaning inside surfaces of a duct comprising:

a traveling means;

means for driving said traveling means forwardly and backwardly in an interior of said duct to be cleaned;

a monitor video camera carried on said traveling means for monitoring a state of cleanness of the interior of said duct;

an oscillatable compressed-air ejecting nozzle carried by said traveling means and oscillable through a predetermined angle around an oscillation axis which is substantially parallel with a central axis of said duct, said predetermined angle through which said compressed-air ejection nozzle is oscillated is 180 degrees;

a non-rotating compressed-air ejecting nozzle carried by said traveling means for directing compressed air to a predetermined inside surface area of said duct;

an air compressor for supplying compressed air to said oscillatable compressed-air ejecting nozzle and said non-rotating compressed-air ejection nozzle through respective control valves;

a monitor image display means for displaying an image taken by said monitor video camera; and a control means for controlling said drive means for said traveling means and controlling said control valves for controlling ejection of compressed air in accordance with an image displayed on said monitor image display means.

4. A system and apparatus as defined in claim 3, wherein said traveling means is equipped with guide rollers for guiding said traveling means precisely along the interior of said duct.

5. A system and apparatus for cleaning inside surfaces of a duct comprising:

a traveling means;

means for driving said traveling means forwardly and backwardly in an interior of the duct to be cleaned;

a monitor video camera supported on said traveling means for monitoring a state of cleanness of the interior of said duct;

a rotatable compressed-air ejection nozzle carried on said traveling means and rotatable through a predetermined angle around a rotation axis of said traveling means;

said rotatable compressed-air ejection nozzle carried by said traveling means such that said rotation axis is parallel with a central axis of said duct;

means to stop the rotation of said rotatable compressed-air ejection nozzle at any position of rotation;

an air compressor fur supplying compressed air to said rotatable compressed-air ejecting nozzle via a control valve in a compressed-air line between said air compressor and said traveling means;

a monitor image display means for displaying an image taken by said monitor video camera; and a control means for controlling said driving means for controlling the travel of said traveling means and for controlling said control valve for ejection of compressed air in accordance with an image displayed on said monitored image display means.

6. A system and apparatus as defined in claim 5, wherein said predetermined angle through which said rotatable compressed-air ejection nozzle rotates is 360 degrees.

7. A system and apparatus for cleaning inside surface of a duct comprising:

a traveling means;

means for driving said traveling means forwardly and backwardly in an interior of said duct to be cleaned;

a monitor video camera carried on said traveling means for monitoring a state of cleanness of the interior of said duct;

a rotatable compressed-air ejecting nozzle carried by said traveling means and rotatable through a predetermined angle around a rotation axis which is substantially parallel with a central axis of said duct;

means to stop the rotation of said rotatable compressed-air ejection nozzle at any position of rotation;

a non-rotating compressed-air ejecting nozzle carried by said traveling means for directing compressed air to a predetermined inside surface area of said duct;

an air compressor for supplying compressed air to said rotatable compressed-air ejecting nozzle and said non-rotating compressed-air ejection nozzle through respective control valves;

a monitor image display means for displaying an image taken by said monitor video camera; and a control means for controlling said drive means for said traveling means and controlling said control valves for controlling ejection of compressed air in accordance with an image displayed on said monitor image display means.

8. A system and apparatus as defined in claim 7, wherein said predetermined angle through which said rotatable compressed-air nozzle rotates is 360 degrees.

* * * * *